United States Patent [19]

Chase

[11] 4,322,723

[45] Mar. 30, 1982

[54] FAULT DETECTION IN A FLAME SCANNER

[75] Inventor: Paul H. Chase, East Granby, Conn.

[73] Assignee: Combustion Engineering, Inc., Windsor, Conn.

[21] Appl. No.: 185,113

[22] Filed: Sep. 8, 1980

[51] Int. Cl.[3] ..... G08B 17/12

[52] U.S. Cl. ..... 340/578; 340/507; 340/511; 340/600

[58] Field of Search ..... 340/578, 511, 508, 506, 340/507, 600

[56] References Cited

U.S. PATENT DOCUMENTS

| | | | |
|---|---|---|---|
| 3,476,945 | 11/1969 | Golden et al. | 340/578 |
| 3,538,332 | 11/1970 | Gilbert | 250/374 |
| 3,594,746 | 7/1971 | Pileika et al. | 340/578 |
| 3,846,772 | 11/1974 | Peberdy | 340/511 |
| 4,039,844 | 8/1977 | MacDonald | 340/578 |
| 4,242,669 | 12/1980 | Crick | 340/508 |

*Primary Examiner*—Glen R. Swann, III

*Attorney, Agent, or Firm*—William W. Habelt

[57] ABSTRACT

A flame scanner has a sensing circuit (10) utilizing a photosensitive device (12) for monitoring and a logic circuit (20) which includes a flame detection circuit (22) and a fault detection circuit (24). The photosensitive device produces a current signal (13) indicative of the intensity of the flame. The current signal is fed to a logarithmic amplifier (14) and converted to a voltage signal (15). The voltage signal (15) powers an LED (18) with its output (4) impinging on the photosensitive device (12). The voltage signal (15) is also transmitted to the flame detection circuit and the fault detection circuit for simultaneous and independent processing. The flame detection circuit continuously processes the signal to determine if a stable flame is present, while the fault detection circuit continuously monitors the integrity of the photosensitive device and its associated sensing circuitry.

6 Claims, 1 Drawing Figure

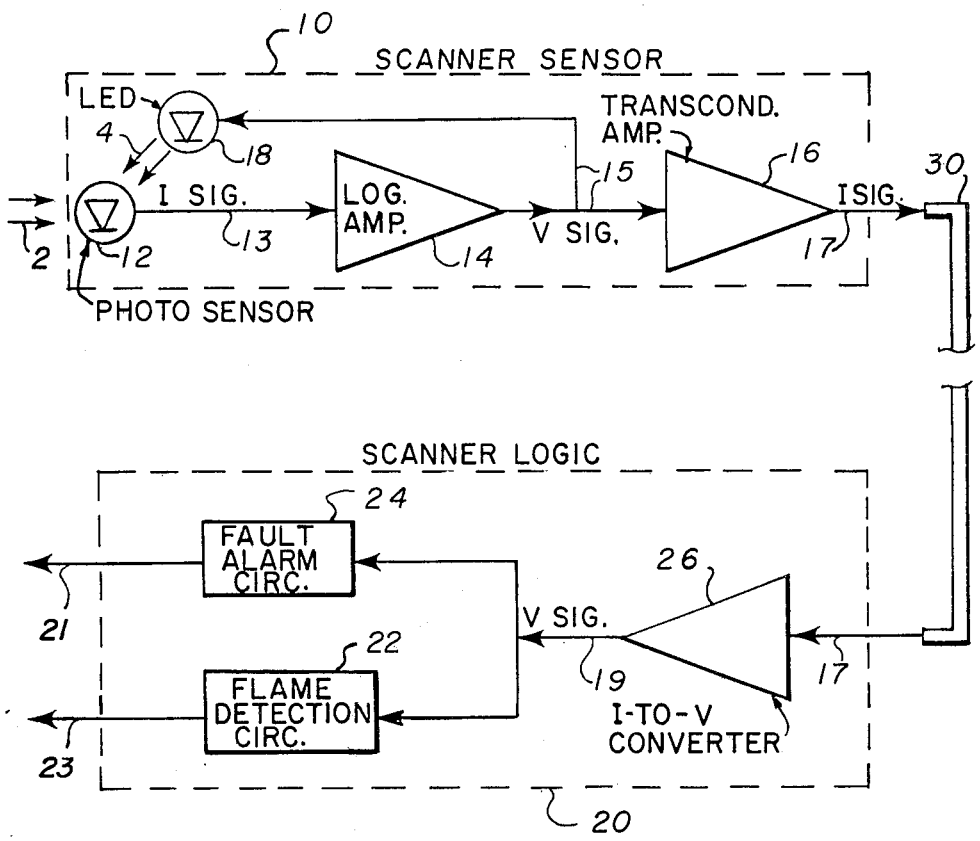
10
SCANNER SENSOR
LED
4
18
TRANSCOND. AMP.
16
15
30
I SIG.
LOG. AMP.
V SIG.
I SIG.
2
12
13
14
17
PHOTO SENSOR
SCANNER LOGIC
24
FAULT ALARM CIRC.
26
21
V SIG.
22
19
17
FLAME DETECTION CIRC.
I-TO-V CONVERTER
23
20

FAULT DETECTION IN A FLAME SCANNER

BACKGROUND OF THE INVENTION

The present invention relates to flame scanners, and more specifically, to an apparatus and method for detecting the presence of a fault in the scanner sensor or connecting cable.

In utility boilers and other devices in which fossil fuels are burned, safety considerations dictate that elaborate fuel and air supply control systems be provided to ensure that once ignition has been achieved and a flame established, fuel and air are not admitted into the combustion chamber unless a flame is present therein. If fuel and air were admitted into a hot combustion chamber wherein the flame had expired, a disasterous explosion could result from accumulation of large quantities of unburnt fuel and air within the combustion chamber. The heart of such a safety system is the flame scanner, the purpose of which is to monitor the flame and provide a signal indicating the presence or absence of flame within the combustion chamber.

The most commonly used flame scanners of today monitor the electromagnetic radiation, i.e., light, produced during the combustion of fossil fuel. A light sensitive sensing device, such as a Geiger-Muller glow discharge tube or a photodiode, views the flame and in response to the varying intensity of the electromagnetic radiation it receives, produces as its output a varying current signal. This current signal is processed through well-known circuitry and an indication of the presence or absence of flame within the combustion chamber is generated.

It is extremely undesirable to have a flame scanner indicate the presence of a flame in the combustion chamber when in fact there is no such flame. A major problem with scanners of the type described above is that they have been known to wrongly indicate the presence of a flame long after the flame within the combustion chamber has expired. One reason for such an occurrence is that the photosensor malfunctions and continues to output a varying current signal even though no light is striking it.

The prior art solution to this problem has been to periodically or randomly activate mechanical means to block the monitoring view of the photosensor so that a flame-out condition is simulated. If the sensor still outputs a varying current signal indicating the presence of a flame within the combustion chamber while the mechanical blocking means is disposed so as to block the sensors view of the flame, the presence of a fault in the photosensor is indicated.

One type of mechanical blocking means well-known in the prior art is the shutter. For example, U.S. Pat. No. 3,538,332 discloses a flame scanner with a sensor head which incorporates a mechanically activated shutter which opens and closes in jaw-like fashion so as to periodically interupt the line of sight between the photosensor and the flame. A disadvantage of the mechanical shutter is that the shutter may stick in the open position thereby preventing a check from being made of the sensor integrity, or it may stick in the closed position thereby rendering the scanner inoperative.

Another type of mechanical blocking means known in the prior art is illustrated in U.S. Pat. No. 3,594,746. Described therein is a flame scanner fault detection system wherein a ball is periodically pneumatically operated to seat in the view port of the scanner head thereby interrupting the scanners view of the flame. When pneumatic activation ceases, the ball drops under the influence of gravity from the scanner view port. If the scanner indicates the presence of flame when the ball is pneumatically activated, the presence of a fault is indicated. A disadvantage of this device is that the ball can become stuck when it seats in the view port of the scanner thereby rendering the scanner inoperative.

Another problem associated with the use of mechanical blocking means in a fault detection system is that they operate either randomly or, at best, periodically rather than continuously. That is, the operation of the scanner must be interrupted in order for the system to be tested for a defect.

Thus, there is evidence in the prior art of a need for a scanner fault detection system which eliminates mechanical blocking means and which may be operated continuously rather than on an intermittent basis. Such a fault detection system will provide the inherent reliability necessary to ensure improved safety during the combustion of fossil fuel.

It is therefore an object of the present invention to provide a scanner fault detection apparatus and method which is capable of continuously monitoring the integrity of the scanner sensing apparatus and procedure and is capable of doing so without relying upon mechanical blocking means.

SUMMARY OF THE INVENTION

The present invention contemplates an improved method and apparatus for detecting the presence of a fault in a flame scanner of the type employing a photosensor for producing a current signal in response to light emitted by a flame and having a flame detection circuit for processing the current signal produced by the photosensor so as to determine if a stable flame is present.

In accordance with the present invention, the improved fault detection apparatus comprises a logarithmic amplifier for converting the current signal produced by the photosensor into an amplified voltage signal, a fault alarm circuit for determining if the amplified voltage signal falls between preselected minimum and maximum levels, means for transmitting the amplified voltage signal from the logarithmic amplifier to the fault alarm circuit, and a light emitting means for producing light in response to the amplified voltage signal. The light emitting means is disposed so that the light emitted strikes the photosensor of the flame scanner. The intensity of the light emitted is directly proportional to the amplitude of the voltage signal produced by the logarithmic amplifier.

In accordance with a preferred embodiment of the invention, the means for transmitting the amplified voltage signal produced by the logarithmic amplifier comprises a transconductance amplifier for converting the voltage signal to a proportional current signal prior to transmission, a current-to-voltage convertor for reconverting the current signal produced by the transconductance amplifier back to a voltage signal after transmission, and conducting means in electrical communication between the transconductance amplifier and the current-to-voltage convertor over which the current signal is transmitted. The voltage signal produced by the current-to-voltage convertor is a proportional reproduction of the voltage signal output of the logarithmic amplifier and serves as input to the fault alarm circuit.

BRIEF DESCRIPTION OF THE DRAWING

The sole FIGURE of the drawing is a block diagram of the preferred embodiment of the improved fault detection apparatus of the present invention employed in a typical prior art flame detector. The light producing means of the fault detection apparatus is shown as a light emitting diode.

DESCRIPTION OF THE PREFERRED EMBODIMENT

Referring now to the drawing, there is illustrated in block diagram form a flame scanner employing the improved fault detection apparatus of the present invention. The flame scanner incorporates a scanner sensor module 10 which houses, inter alia, a photosensor 12 for monitoring a flame, and a scanner logic circuit module 20 which houses an electronic circuit for determining whether or not a stable flame is present. In a typical application, the flame scanner sensor module 10 would be installed in the wall of a furnace to monitor the combustion of a fossil fuel therein. The scanner logic circuit module 20, because of the sensitivity to high temperatures of the electronic circuitry housed therein, is normally stationed remotely from the furnace at a control center wherein a conditioned environment can be readily maintained.

In operation, electromagnetic radiation 2, i.e., light, emitted by the flame during the combustion of a fossile fuel is received by the photosensor 12. In response to the received light 2, the photosensor 12 produces a current signal 13 which is indicative of the intensity of the flame being monitored. Typically, modern day flame scanners utilize a solid state semi-conductor device such as a photodiode or a phototransistor as the photosensor 12, although Geiger-Muller phototubes, photoelectric cells of materials such as cadmium sulfide or lead sulfide, and other known photosensitive devices are also used as photosensors in flame scanners. It is contemplated that the fault detection apparatus and method of the present invention may be employed in flame scanners utilizing photosensors comprised of any of the known photosensitive devices.

The current signal 13 produced by the photosensor 12 is typically amplified and converted to a voltage signal prior to being analyzed in a flame detection circuit 22 to determine if a stable flame is present. It is contemplated that the fault detection apparatus of the present invention may be utilized in conjunction with any of the various flame detection circuits known in the art.

The present invention provides an improved fault detection apparatus which serves to monitor the integrity of the photosensor 12, the remainder of the sensor module circuitry and even the conductor cables which transmit the sensor module output to the logic module 20.

In accordance with the present invention, the improved fault protection apparatus comprises a logarithmic amplifier 14 for converting the current signal 13 produced by the photosensor 12 into an amplified voltage signal 15, a fault alarm circuit 24 for determining if the amplified voltage signal 15 falls between preselected minimum and maximum limits, means 16, 30, 26 for transmitting the amplified voltage signal 15 from the logarithmic amplifier 14 to the fault alarm circuit 24, and a light emitting means 18 for producing light 4 in response to the amplified voltage signal 15.

The logarithmic amplifier 14 is disposed within the scanner sensor module 10 to receive as its input the current signal 13 produced by the photosensor 12. In response thereto, the logarithmic amplifier 14 produces as its output a voltage signal 15 which is a logarithmic characterization of the current signal 13 received from the photosensor 2. The logarithmic amplifier 14 outputs a high amplitude voltage signal in response to a low amplitude current signal and a low amplitude voltage signal in response to a high amplitude voltage signal. Because of the logarithmic characteristics of the amplifier 14, the receipt of even a very small amplitude current signal will trigger the production of a voltage signal of sufficient amplitude to be utilized and processed.

The voltage signal 15 produced by the logarithmic amplifier 14 is transmitted to scanner logic circuit module 20 for processing in fault alarm circuit 24 and flame detection circuit 22. The voltage signal 15, an amplified logarithmic representation of the current signal 13 generated by the photosensor 12, is analyzed within the flame detection circuit 22 in accordance with well-known techniques to produce an output signal 23 which is indicative of the status of the flame. If the output signal 23 indicates the presence of a stable flame, fuel and air flow to the furnace will continue. Conversely, if the output signal 23 indicates the absence of a stable flame, fuel and air flow to the furnace will be interrupted thereby preventing an explosion.

Fault alarm circuit 24 is disposed in parallel with the flame detection circuit 22 so that the signal generated by the photosensor is simultaneously and independently analyzed for both flame and fault detection. If the voltage signal 15 has amptitude between a preselected minimum level and a preselected maximum level, the alarm circuit 24 will produce an output signal 21 indicating that no fault is present. However, if the voltage signal 15 exhibits an amplitude below a preselected minimum level or above the preselected maximum level, the fault alarm circuit 24 will produce an output signal 21 indicating that a fault exists and that the scanner cannot be giving an accurate indication of flame presence. In response to this indication, the flow of fuel and air to the furnace will be shut off.

In addition to being transmitted to the scanner logic circuit module 20 for processing in a fault alarm circuit 24 housed therein, the voltage signal 15 is fed back as an input signal to a light producing means 18, shown in the preferred embodiment as a light emitting diode. The light emitting diode 18 which, as this name implies, emits light 4 as its output in response to the voltage signal 15, is disposed within the scanner sensor module 10 so that the emitted light 4 strikes the photosensor 12.

The intensity of the light 4 emitted by the light emitting diode 18 is directly proportional to the amplitude of the received voltage signal 15. Thus, if the voltage signal 15 is of low amplitude, as is the case when the light from a bright intense flame strikes the photosensor 12, the light 4 emitted by the light emitting diode 18 will be of a low intensity so as to be insignificant when compared to the light 2 emitted by the flame. Thus, the light from the diode 18 will not significantly alter the amplitude of the current signal 13 produced by the photosensor 12. Accordingly, an accurate determination of the presence of flame can still be made in the flame detection circuit 22 by analyzing the voltage signal 15.

Conversely, when the voltage signal 15 increases in amplitude as is the case when the flame is in the process of extinguishing, the light 4 emitted by the light emitting diode 18 will also rise in amplitude. When the flame finally extinguishes the photosensor 12 will respond solely to the light 4 emitted by the diode 18 and in response thereto continues to produce a current signal 13 even though the flame is out. Therefore, even when no flame is present a signal will be continuously produced and transmitted to the fault alarm circuit 24 for processing as described previously, thereby permitting, unlike the prior art, a continuous testing of the integrity of the photosensor 18, the electronic circuitry of the scanner sensor module, and the transmission cable even when the flame is out. When a photosensor fails it will fail by shorting either fully open or fully closed. That is, the current signal produced by the photosensor will be either near 0 or extremely high. The corresponding voltage signal output by the logarithmic amplifier will accordingly be either above or below the preselected limits and a fault alarm will be generated. The maximum and minimum limits are preselected such that the voltage signal 15 generated from a current signal 13 which is produced by the photodiode 12 when it senses only the light 4 emitted by the light emitting diode 18 will have an amplitude between the maximum and minimum levels.

In transmitting a signal from the scanner sensor module 10 to the scanner logic circuit module 20, which may be located hundreds of feet away, it is preferred to transmit a current signal rather than a voltage signal. A current signal by nature is less susceptible to electromagnetic interference in long transmission runs than is a voltage signal. Furthermore, a current signal unlike a voltage signal can be transmitted over long distances without strain attenuation.

In accordance with the present invention, the means for transmitting the voltage signal 15 from the logarithmic amplifier 14 disposed within the scanner sensor module 10 to the fault detection alarm circuit 24 disposed within the scanner logic circuit module 20 comprises a transconductance amplifier 16 disposed within the scanner sensor module 10, a current to voltage converter 26 disposed within the scanner logic circuit module 20, and conducting means, such as transmission cable 30, inner connecting the transconductance amplifier 16 and electrical communication with the current to voltage converter 26.

The transconductance amplifier 16 receives as its input the voltage signal 15 from the logarithmic amplifier 14 and produces as its output a current signal 17 proportional to the received voltage signal 15. The current signal 17 is transmitted through conducting means 30 from its transconductance amplifier 16 to the current-to-voltage converter 26 which is disposed in the scanner logic circuit module 20 which, as mentioned previously, is normally disposed at a location remote from the scanner sensor module 10.

The current-to-voltage converter 26 receives as its input the transmitted current signal 17 and converts it back to a voltage signal 19 which is proportional to the current signal 17. The voltage signal 19 is therefore a duplicate or, if desired, an amplified reproduction of the voltage signal 15 produces by the logarithmic amplifier 14. The voltage signal 19 output from the current-to-voltage converter 26 then pass to the fault alarm circuit 22 for analyzing in the manner described hereinbefore to determine if a fault is present.

Thus, in accordance with the present invention there has been provided an improved fault detection apparatus and method which is capable of continuously monitoring the integrity of scanner sensing apparatus, including the photosensor, the scanner sensing circuitry and any transmission cables. Furthermore, the invention provides an apparatus which is capable of doing so without relying upon mechanical blocking means.

While only one embodiment of the invention have been shown, it will be appreciated that modifications thereof, some of which have been eluded to herein, may readily be made thereto by those skilled in the art. Therefore, it is intended by the impended claims to cover the modifications eluded to herein as well as all other modifications which fall within the true spirit and scope of the invention.

I claim:

1. In a flame scanner of the type having a photosensor for producing a current signal in response to light emitted by a flame, and a flame detection circuit for processing the current signal produced by said photosensor so as to determine if a stable flame is present, a fault detection apparatus for detecting the presence of a fault in the flame scanner, said fault detection apparatus comprising:

a. a logarithmic amplifier for receiving as its input the current signal produced by said photosensor and for producing as its output a voltage signal which represents a logarithmic characterization of the current signal received from said photosensor;

b. light producing means for receiving as its input the voltage signal output of said logarithmic amplifier and emitting light in response thereto, the intensity of the emitted light being directly proportional to the amplitude of the received voltage signal, said light producing means being disposed so that the emitted light strikes said photosensor;

c. a fault alarm circuit disposed in parallel with said flame detection circuit, said fault alarm circuit receiving as its input the voltage signal output of said logarithmic amplifier and producing as its output an alarm signal whenever the amplitude of the received voltage signal falls below a preselected minimum level or rises above a preselected maximum level; and d. means for transmitting the voltage signal output of said logarithmic amplifier to said fault alarm circuit.

2. A flame scanner as recited in claim 1 wherein said photosensor comprises a photodiode.

3. A flame scanner as recited in claims 1 or 2 wherein said light producing means comprises a light emitting diode.

4. A flame scanner as recited in claim 3 wherein said means for transmitting the voltage signal output of said logarithmic amplifier to said fault alarm circuit comprises:

a. a transconductance amplifier for receiving as its input the voltage signal output of said logarithmic amplifier and producing as its output a current signal proportional to the received voltage signal;

b. a current to voltage converter receiving as its input the current signal output of said transconductance amplifier and producing as its output an amplified voltage signal proportional to the received current signal, said voltage output signal thereby being a reproduction of the voltage output signal of said logarithmic amplifier; and c. conducting means interconnected in electrical communication between said transconductance amplifier and said current to voltage converter for transmitting the current signal output of said transconductance amplifier to said current-to-voltage converter.

5. In a method of flame scanning including the steps of producing by means of a photosensor a current signal in response to light emitted by a flame and processing the produced current signal through a flame detection circuit so as to determine if a stable flame is present, a method of detecting the presence of a fault in the flame sensing procedure comprising the steps of:

a. converting the produced current signal to an amplified voltage signal which is logarithmic characterization of the produced current signal;

b. continuously generating light in response to the amplified voltage signal and impinging said generated light on said photosensor, the intensity of the light generated varying proportionally with the amplitude of the amplified voltage signal;

c. continuously monitoring the amplitude of the amplified voltage signal; and d. generating an alarm signal whenever the amplitude of the amplified voltage falls below a preselected minimum level or raises above a preselected maximum level.

6. A method as recited in claim 5 further comprising the steps of:

a. prior to monitoring the amplitude of the amplified voltage signal, converting the amplified voltage signal to a proportional current signal;

b. transmitting the proportional current signal; and c. receiving the transmittal proportional current signal and reconverting it back to a voltage signal, the reconverted voltage signal thereby being a proportional representation of the amplified voltage signal suitable for monitoring.

* * * * *